US006877606B2

(12) United States Patent
Hardy

(10) Patent No.: US 6,877,606 B2
(45) Date of Patent: Apr. 12, 2005

(54) LINEAR FLUORESCENT LAMP END CAP LOCKING SYSTEM

(75) Inventor: Gregory J. Hardy, Middleton, MA (US)

(73) Assignee: Osram Sylvania Inc., Danvers, MA (US)

( * ) Notice: Subject to any disclaimer, the term of this patent is extended or adjusted under 35 U.S.C. 154(b) by 115 days.

(21) Appl. No.: 10/394,857

(22) Filed: Mar. 21, 2003

(65) Prior Publication Data

US 2004/0099556 A1 May 27, 2004

Related U.S. Application Data

(60) Provisional application No. 60/429,999, filed on Nov. 27, 2002.

(51) Int. Cl.[7] ..... B65D 85/42

(52) U.S. Cl. ..... 206/419; 206/593

(58) Field of Search ..... 206/418–422, 206/443, 591–594, 784; 229/87.02, 89, 120.08, 120.11, 120.12, 120.14–120.18, 120.23

(56) References Cited

U.S. PATENT DOCUMENTS 1,985,075 A * 12/1934 Bird ..... 206/418
2,692,077 A * 10/1954 Kuhlman ..... 206/418
2,870,949 A * 1/1959 Currivan ..... 206/418
3,337,033 A * 8/1967 Cote ..... 206/418
4,231,510 A * 11/1980 Beard ..... 206/422
4,880,114 A * 11/1989 Korte ..... 206/418
5,730,289 A * 3/1998 Cappels ..... 206/418

* cited by examiner

*Primary Examiner*—Luan K. Bui
(74) *Attorney, Agent, or Firm*—William E. Meyer

(57) ABSTRACT

A locking system for two linear fluorescent lamps comprises an endcap (10) formed to receive two linear fluorescent lamps (12, 14) (FIG. 3). The endcap (10) has two chambers (16, 18) formed by the outside surfaces of endcap (10) and a central partition (19). Each of the chambers has a forward portion (20) and a rearward portion (22). The endcap (10) has a height H equal to the diameter of the fluorescent lamps, a width W equal to twice the diameter of the fluorescent lamps and a length, for example, 4 to 6 inches, that is substantially less than the length of the lamps, which can be one to eight feet long. A stop (24) is formed in each of the chambers at the forward portion (20) to retain the lamps within the endcap. Each of the stops (24), in the form of a reverse corner, extends inwardly toward the center of the endcap and has a first leg (26) with a first dimension equal to the height H and a second leg (28) with a second dimension that is greater than one half of said height H but less than the height H.

3 Claims, 2 Drawing Sheets

LINEAR FLUORESCENT LAMP END CAP LOCKING SYSTEM

This application claims priority from Provisional Patent Application No. 60/429,999, filed Nov. 27, 2002.

TECHNICAL FIELD

This invention relates to linear fluorescent lamps and more particularly to packaging for such lamps. Still more particularly it relates to packaging for small quantities of such lamps.

BACKGROUND ART

Previous techniques for packaging small quantities of fluorescent lamps (for example, two lamps or four lamps) employed endcaps formed from folding carton material or paper or cardboard with inwardly extending dimples in an F-shape to extend across the ends of the lamps and a shrink-wrap to complete the package.

While workable, these endcaps were difficult to manufacture and difficult to automate. Additionally, the shrink-wrap was difficult to apply and added to the cost of lamps.

DISCLOSURE OF INVENTION

It is, therefore, an object of the invention to obviate the disadvantages of the prior art.

It is another object of the invention to enhance fluorescent lamp packaging.

Yet another object of the invention is the provision of endcaps that do not have to be shrink-wrapped.

These objects are accomplished, in one aspect of the invention, by the provision of a locking system for two linear fluorescent lamps, comprising an endcap formed to receive two linear fluorescent lamps, the endcap having two chambers each with a forward portion and a rearward portion. The endcap has a height equal to the diameter of the fluorescent lamps, a width equal to twice the diameter of the fluorescent lamps, a divider between the two chambers that at least in one area has a thickness that is three times the thickness of the endcap material, and a length that is substantially less than the length of said lamps. A stop is formed in each of the chambers at the forward portion and each of the stops extends inwardly toward the center of the endcap and has a first leg with a first dimension equal to the height of endcap and a second leg with a second dimension that is greater than one half of the height. The inwardly-formed stop locks behind the lamp base pins when lamps are inserted into the chambers.

Additionally, each endcap has an upper surface and a lower surface, and one of the surfaces has a tab formed therein, the tab extending inwardly of the endcap and positioning between the lamps, adding to the separation between the lamps An adhesive is dispensed through the opening formed by the tab and adheres one of the lamps to the tab thus securing the endcaps to the lamps and eliminating the need for a shrink-wrap

BRIEF DESCRIPTION OF THE DRAWINGS

FIG. 4 is a perspective view of an endcap in accordance with an aspect of the invention before the corners are folded in.

BEST MODE FOR CARRYING OUT THE INVENTION

For a better understanding of the present invention, together with other and further objects, advantages and capabilities thereof reference is made to the following disclosure and appended claims in conjunction with the above-described drawings.

Figure 1:
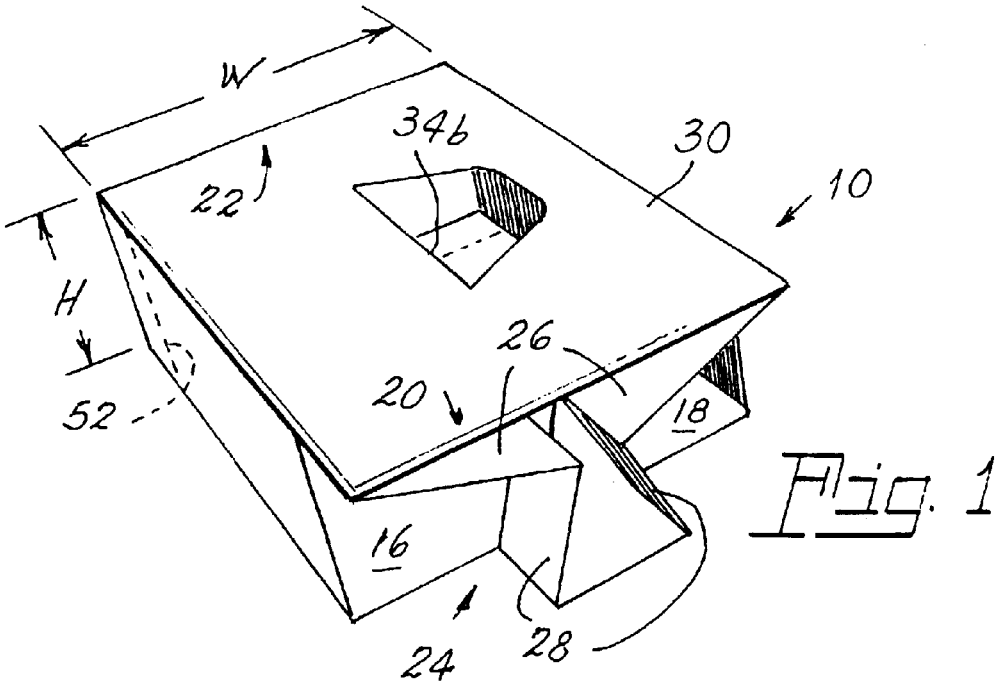
FIG. 1 is a perspective view of an endcap illustrating an embodiment of the invention.
Figure 3:
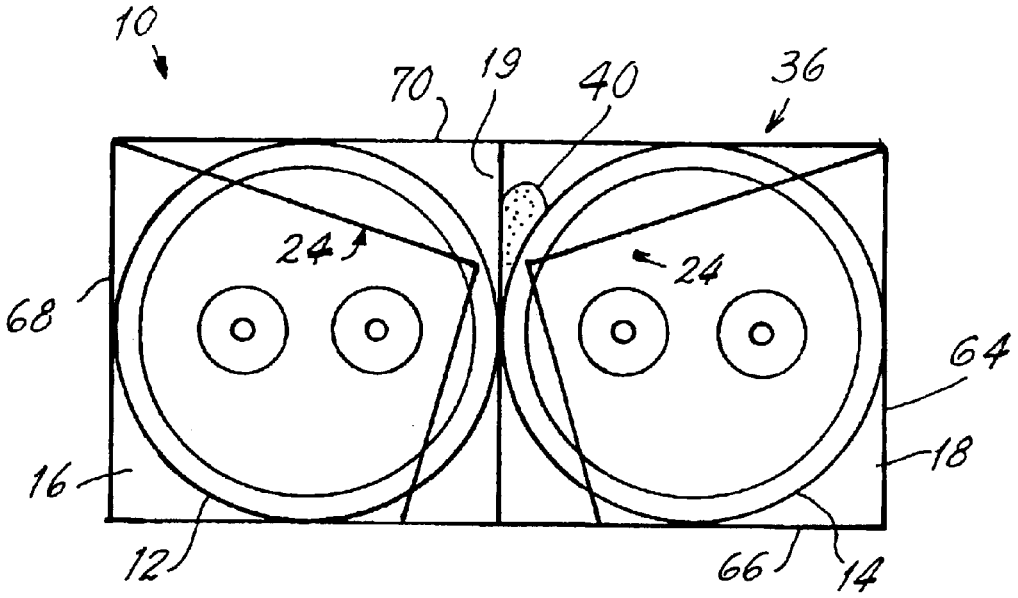
FIG. 3 is a similar, diagrammatic view of an endcap with a pair of lamps enclosed by the endcap and the thickness of the material minimized, again, for clarity.

Referring now to the invention with greater particularity, there is shown in FIG. 1 a locking system for two linear fluorescent lamps, comprising an endcap 10 formed to receive two linear fluorescent lamps 12, 14 (FIG. 3). The endcap 10 has two chambers 16, 18 formed by the outside surfaces of endcap 10 and a central partition 19. Each of the chambers has a forward portion 20 and a rearward portion 22. The endcap 10 has a height H equal to the diameter of the fluorescent lamps, a width W equal to twice the diameter of the fluorescent lamps, a center divider 19 that at least in one area has a thickness that is three times the thickness of the endcap material, as will be explained hereinafter, and a length, for example, 4 to 6 inches, that is substantially less than the length of the lamps, which can be from one to eight feet long or greater. A stop 24 is formed in each of the chambers at the forward portion 20 to retain the lamps within the endcap. Each of the stops 24, in the form of a reverse corner, extends inwardly toward the center of the endcap and has a first panel 26 with a first dimension equal to the height H and a second panel 28 with a second dimension that is greater than one half of said height H but less than the height H. When the panels are reverse-folded they must extend beyond the lamp base pins, insuring that the panels cannot collapse to original position 50 (shown in FIG. 4)

The stops 24 are formed by cutting the sides 50 of the endcap from top to bottom to form a slit 52 and by cutting the lower surface 32 to form a slit 54, thus allowing the corner to be pushed inwardly toward the center of endcap 10 and forming the stop 24. The appropriate slits are shown by dashed lines in FIG. 4.

Figure 2:
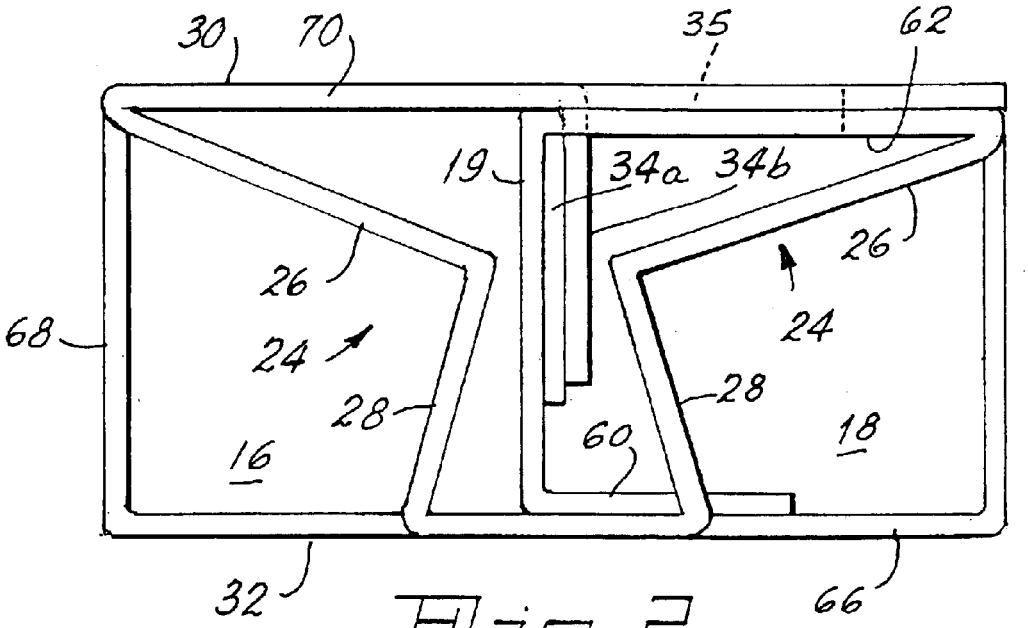
FIG. 2 is an elevational end view of an endcap with the thickness of the material exaggerated for clarity.

The endcaps 10 have an upper surface 30 and a lower surface 62 that have tabs 34*a* and 34*b* formed therein that extend inwardly and rest against center divider 19, thus effectively making at least a portion of the divider 19 three times the thickness of the endcap material. This feature is shown most clearly in FIG. 2 and provides for greater separation between the lamps 12 and 14.

Again referring to FIG. 2, the endcap is preferably made from a single sheet of material that is scored to allow folding of the material into the endcap unit. Thus, the endcap structure comprises an extension 60, the center partition 19, a top 62 for chamber 18, a descending wall 64, a bottom 66, an ascending wall 68 for chamber 16 and an overlying cover 70. Glue is applied between extension 60 and bottom 66 and overlying cover 70 and top 62.

Figure 4:
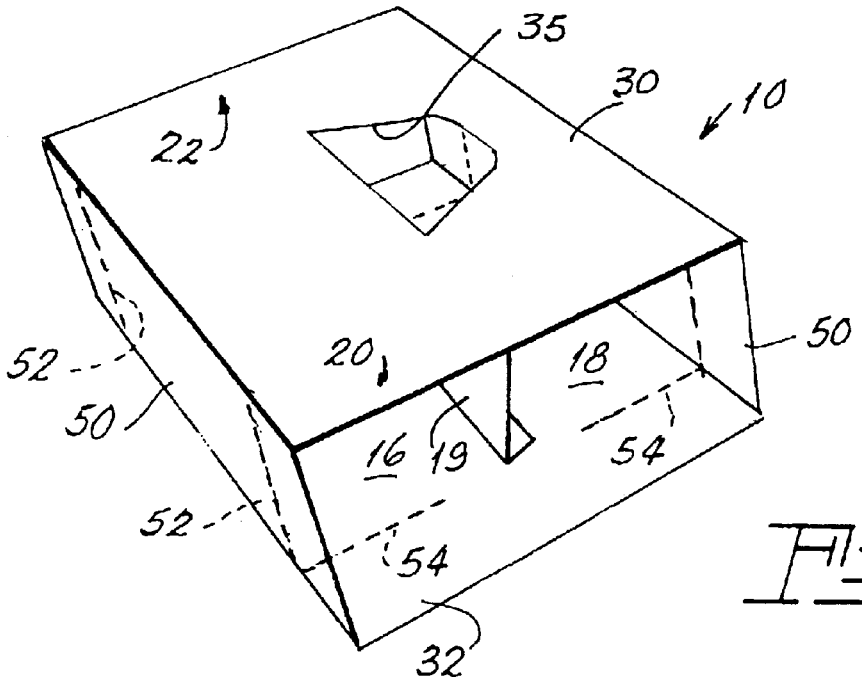

As can be seen from FIGS. 1 and 4, the slits 52 and 54 can be formed on both ends of the endcap, although only one set will be employed to form the stops 24.

The endcaps when assembled are used to form a fluorescent lamp package 36 that comprises two linear fluorescent lamps 12, 14 arranged side-by-side with an endcap 10 at either end (see FIG. 3). The endcaps are slid upon the lamps until contact is made with the stops 24.

A quantity of adhesive 40 about the size of a U.S. quarter (i.e., about one inch or 2.54 cm in diameter) is dispensed through the opening 35 provided by tabs 34*a* and 34*b* and adheres to the exposed lamp and tab 34*b* on both endcaps. The adhesive should not be exposed to the outer surface 70 of the endcap. Note: the second lamp is locked in place by the two endcaps adhering to the same lamp. The left and right endcaps must have the same opening orientation to ensure that the same lamp is adhered to both endcaps.

It is preferable that the adhesive 40 will release from the glass lamp cleanly when the endcaps are removed by the ultimate user of the lamps; also the adhesive must have a bond sheer strength that can withstand user handling and remain in place until the user desires to use the lamps. In a preferred embodiment of the invention, this adhesive is preferably one designated HM2703 and available from the H. B. Fuller Company, or one designated H5077 and available from Bostik Findley.

A preferred material for the endcaps is 0.020 CCRB clay coated recycled board.

Thus, there is provided by this invention an endcap for packaging linear fluorescent lamps that obviates the use of shrink-wrap and that is easy to manufacture and to assemble. The design readily adapts to the use of automated equipment and contributes to material and equipment maintenance savings.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A linear fluorescent lamp package comprising two linear fluorescent lamps arranged side-by-side and provided with an endcap at each end, each of said endcaps having two chambers each with a forward portion and a rearward portion, said endcaps having a height equal to the diameter of said fluorescent lamps, a width equal to twice the diameter of said fluorescent lamps and a length that is substantially less than the length of said lamps; each of said chambers being formed to receive a lamp and having a stop formed therein, each of said stops extending inwardly toward the center of said endcap and having a first leg with a first dimension equal to said height and a second leg with a second dimension that is greater than one half of said height.

2. The linear fluorescent lamp package of claim 1 wherein each of said endcaps has an upper surface and a lower surface and one of said surfaces has a tab formed therein, said tab extending inwardly, and an adhesive fixing said tab to one of said lamps.

3. The package of claim 2 wherein said adhesive is initially flowable.

* * * * *